US010072871B1

(12) United States Patent
Shaffer

(10) Patent No.: US 10,072,871 B1
(45) Date of Patent: Sep. 11, 2018

(54) CORROSION INHIBITOR MODULE FOR A PACKAGED TERMINAL AIR CONDITIONER UNIT

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/455,191

(22) Filed: Mar. 10, 2017

(51) Int. Cl.
*F24F 13/22* (2006.01)
*F24F 1/02* (2011.01)

(52) U.S. Cl.
CPC ..... *F24F 13/224* (2013.01); *F24F 1/027* (2013.01); *F24F 2013/228* (2013.01)

(58) Field of Classification Search
CPC .... F24F 13/224; F24F 1/027; F24F 2013/228; F24F 11/30; F24F 11/83; F24F 11/77; F24F 11/85; F24F 11/42; F24F 11/58; F24F 11/04; F24F 11/008
USPC ..... 62/262, 285
See application file for complete search history.

(56) References Cited

U.S. PATENT DOCUMENTS 3,191,401 A * 6/1965 Beyer ..... F24F 13/224 137/268
6,331,202 B1 * 12/2001 Pipko ..... C09D 5/086 106/14.05
6,679,400 B1 * 1/2004 Goodman ..... B67D 1/16 137/312
2003/0029183 A1 * 2/2003 Ohama ..... F24F 1/027 62/262
2005/0008532 A1 * 1/2005 Jenkins ..... C23F 11/149 422/14
2007/0234474 A1 * 10/2007 Gontar ..... A47K 3/40 4/613
2011/0226443 A1 * 9/2011 Siegel ..... F24F 1/027 165/59
2013/0139537 A1 6/2013 Kuijt et al.
2013/0220982 A1 * 8/2013 Thomas ..... B23K 26/0081 219/121.69
2014/0026648 A1 * 1/2014 Schmitz ..... G05D 21/02 73/61.59
2016/0313014 A1 * 10/2016 Phillips ..... F24F 13/20
2016/0348926 A1 * 12/2016 Bailey ..... F24F 1/027

* cited by examiner

*Primary Examiner* — Mohammad M Ali
(74) *Attorney, Agent, or Firm* — Dority & Manning, P.A.

(57) ABSTRACT

A corrosion inhibitor module for a packaged terminal air conditioner unit (PTAC) is provided. Condensate is pumped from a drain pan of the PTAC into a housing of the corrosion inhibitor module. The housing contains a corrosion inhibitor concentrate that is mixes with the condensate to form an inhibitor solution that is returned to the drain pan to prevent the corrosion of components that come in contact with the condensate.

20 Claims, 6 Drawing Sheets

CORROSION INHIBITOR MODULE FOR A PACKAGED TERMINAL AIR CONDITIONER UNIT

FIELD OF THE INVENTION

The present disclosure relates generally to air conditioner units, and more particularly to packaged terminal air conditioner units that are resistant to corrosion.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. Oftentimes, PTACs are used in hot and humid environments having high salinity, e.g., in tropical environments. Such regions are prone to weather and ambient conditions that can accelerate corrosive action and damage to PTAC components. Corrosion resistant materials may be used, but are often cost prohibitive and fail after prolonged exposure.

Accordingly, improved air conditioner units with features for reducing corrosion would be useful. More specifically, packaged terminal air conditioner units with simple and cost-effective features for reducing or eliminating harmful corrosion would be particularly beneficial.

BRIEF DESCRIPTION OF THE INVENTION

The present subject matter provides a corrosion inhibitor module for a packaged terminal air conditioner unit (PTAC). Condensate is pumped from a drain pan of the PTAC into a housing of the corrosion inhibitor module. The housing contains a corrosion inhibitor concentrate that mixes with the condensate to form an inhibitor solution that is returned to the drain pan to prevent the corrosion of components that come in contact with the condensate. Additional aspects and advantages of the invention will be set forth in part in the following description, may be obvious from the description, or may be learned through practice of the invention.

In accordance with one embodiment, a packaged terminal air conditioner unit is provided. The packaged terminal air conditioner unit includes an outdoor heat exchanger disposed in an outdoor portion, an indoor heat exchanger disposed in an indoor portion, and a bulkhead disposed between the outdoor heat exchanger and the indoor heat exchanger along a transverse direction, the bulkhead defining the indoor portion and the outdoor portion. A drain pan defines a reservoir for collecting condensate from the indoor heat exchanger and the outdoor heat exchanger. A corrosion inhibitor module includes a corrosion inhibitor concentrate within a housing defining an inlet and an outlet. An intake conduit provides fluid communication between the reservoir and the inlet of the housing and a circulation pump is operatively coupled to the intake conduit for urging a flow of condensate from the reservoir and into the housing, the flow of condensate mixing with the corrosion inhibitor concentrate to form an inhibitor solution that flows back into the reservoir through the outlet.

In accordance with another embodiment, a corrosion inhibitor module for a packaged terminal air conditioner unit is provided. The packaged terminal air conditioner unit includes a drain pan defining a reservoir for collecting condensate from an indoor heat exchanger and an outdoor heat exchanger. The corrosion inhibitor module includes a housing defining a chamber having an inlet and an outlet and a corrosion inhibitor concentrate positioned within the housing. An intake conduit provides fluid communication between the reservoir and the inlet of the housing and a circulation pump is operatively coupled to the intake conduit for urging a flow of condensate from the reservoir and into the chamber, the flow of condensate mixing with the corrosion inhibitor concentrate to form an inhibitor solution that flows back into the reservoir through the outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
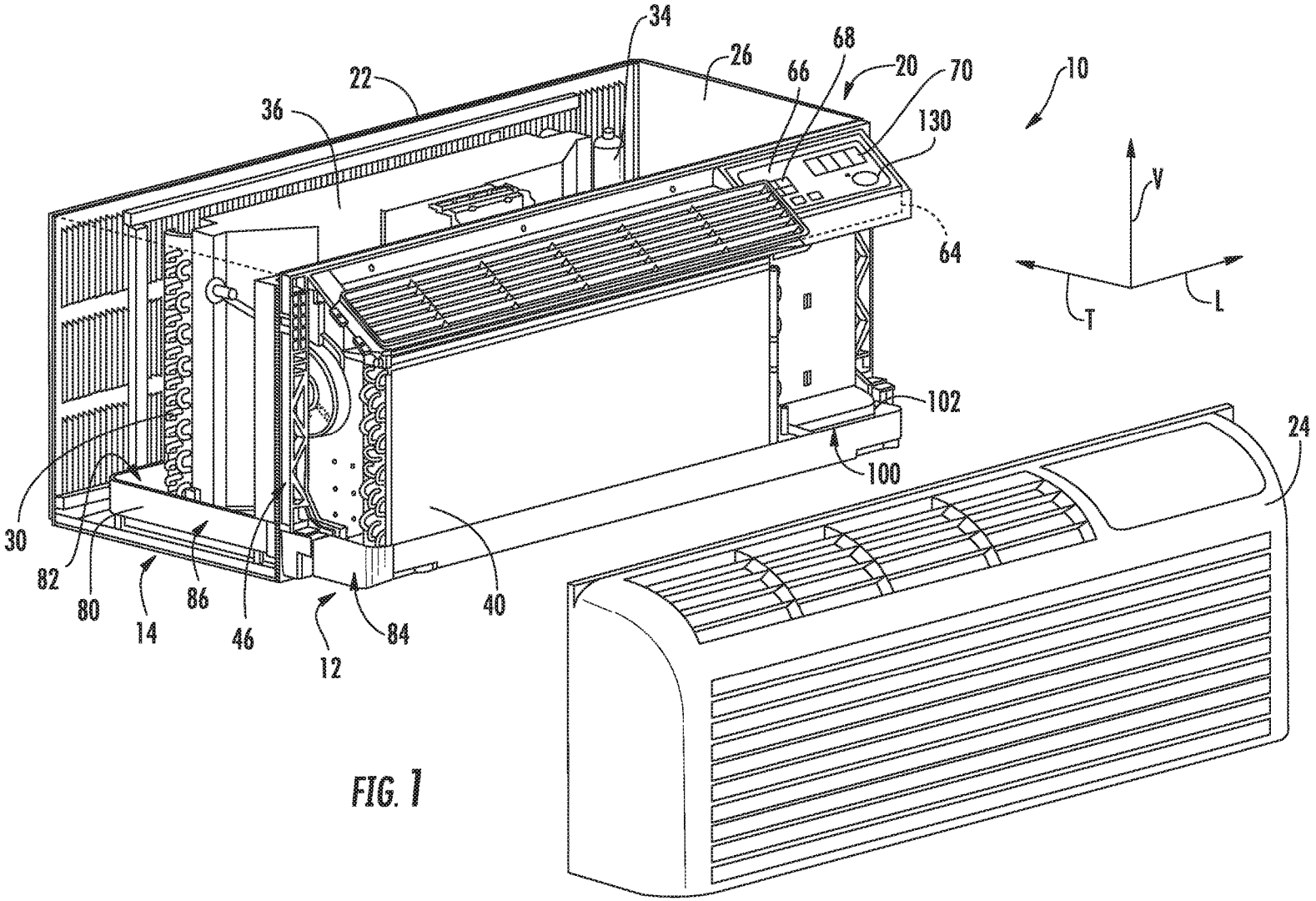
FIG. 1 provides a perspective view of an air conditioner unit, with part of an indoor portion exploded from a remainder of the air conditioner unit for illustrative purposes, in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32 (FIG. 2), and a compressor 34 may be housed within the wall sleeve 26. A casing 36 may additionally enclose the outdoor fan, as shown.

Figure 2:
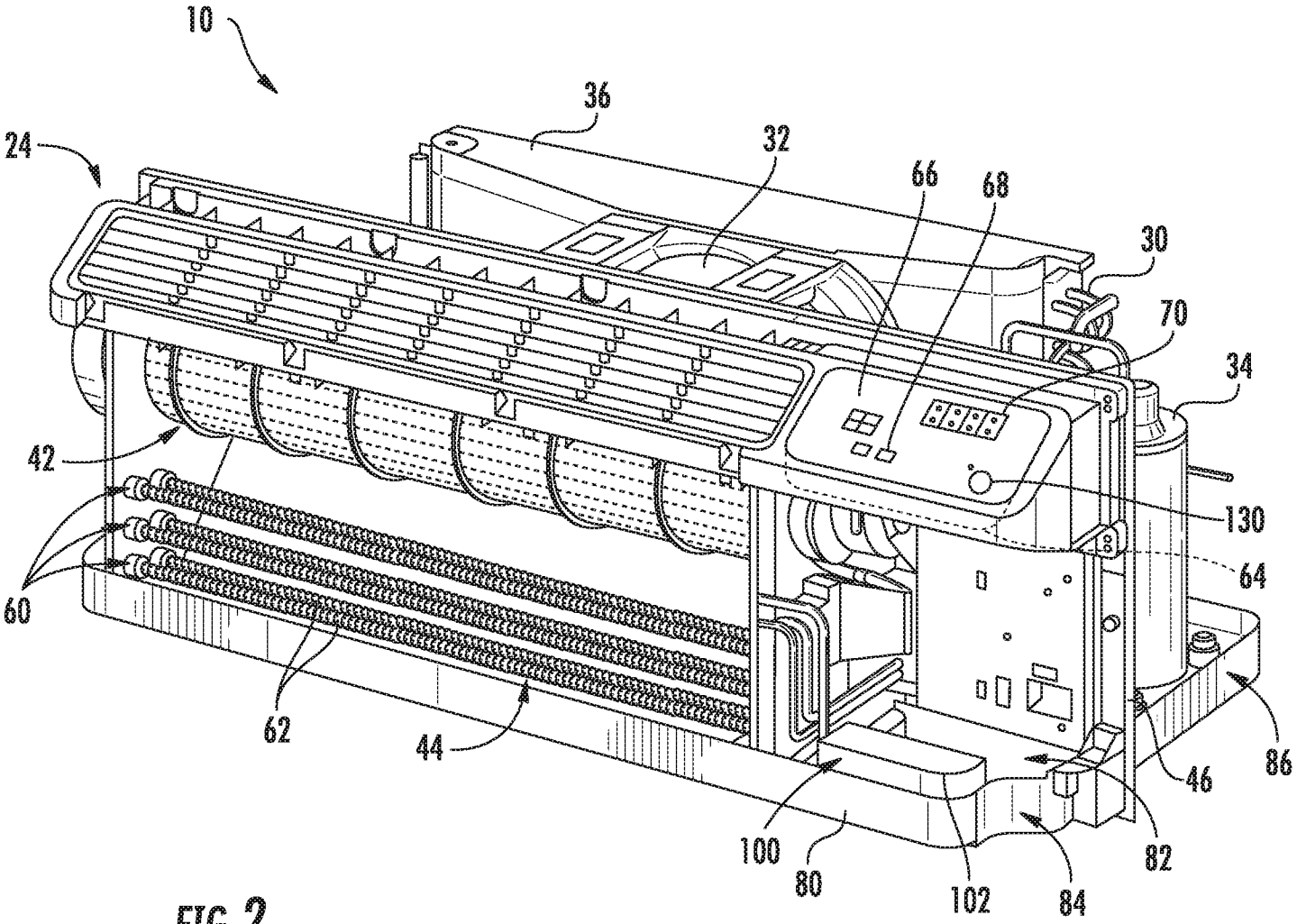
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
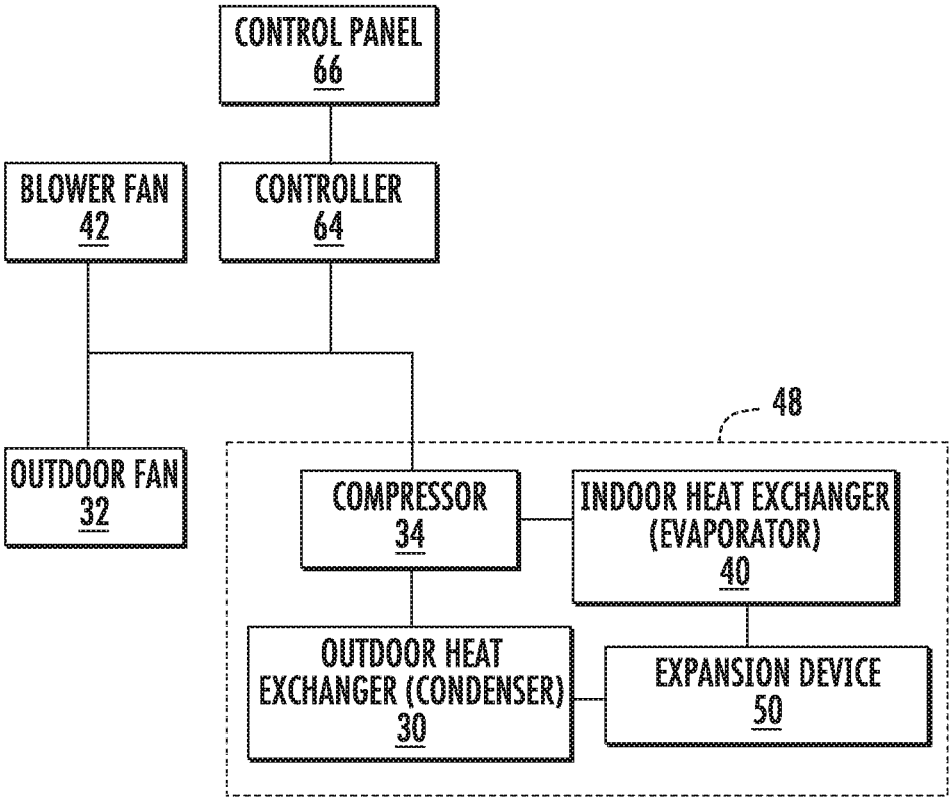
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. One suitable refrigerant for use in refrigeration loop 48 is pentafluoroethane, also known as R410*a*, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Alternatively, blower fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. By way of example, the controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Referring again to FIGS. 1 and 2, unit 10 includes a drain pan 80 positioned below outdoor heat exchanger 30 and indoor heat exchanger 40 along the vertical direction V. Drain pan 80 has raised sides and defines a reservoir 82 for collecting condensate that drips off of outdoor heat exchanger 30 and indoor heat exchanger 40. According to an exemplary embodiment, drain pan 80 is divided into an indoor portion 84 and an outdoor portion 86 by bulkhead 46.

Drain pan 80 and/or bulkhead 46 may define one or more fluid passageways to allow collected condensate to drain out of unit 10. For example, drain pan 80 may generally be slanted downward along the vertical direction V and to the rear of the unit along the transverse direction T (e.g., toward a location proximate outdoor heat exchanger 30). In addition, a weep hole (not shown) may be defined in the rear of drain pan 80 and bulkhead 46 may define a slot (not shown) such that collected condensate collects and drain toward the rear of unit 10 and out of the weep hole.

Notably, as condensate is generated and collects in reservoir 82, corrosion may form on various components throughout unit. Particularly, in tropical, humid environments, generated condensate may have a relatively high salinity and can result in the quick and harmful formation of rust on any components of unit 10 exposed to the condensate. In this regard, for example, galvanic cells can be created using the conductive condensate in reservoir 82 as the medium for the exchange of ions between aluminum, steel, and copper components used within the sealed system or refrigeration loop 48 and/or other PTAC unit 10 components.

According to an exemplary embodiment of the present subject matter, unit 10 may further include a corrosion inhibitor module 100 to reduce or eliminate corrosion and the formation of rust. For example, referring still to FIGS. 1 and 2, corrosion inhibitor module 100 may include a housing 102 configured for introducing a corrosion inhibiting solution into the reservoir 82 for reducing corrosion, as described below. According to the illustrated embodiment, housing 102 is positioned within indoor portion 84 of drain pan 80 such that it may be easily replaced when needed by removing room front 24. However, it should be appreciated that housing 102 may be placed at any suitable location within or proximate to unit 10 such that corrosion inhibiting solution may be introduced into reservoir 82 of drain pan 80.

Figure 4:
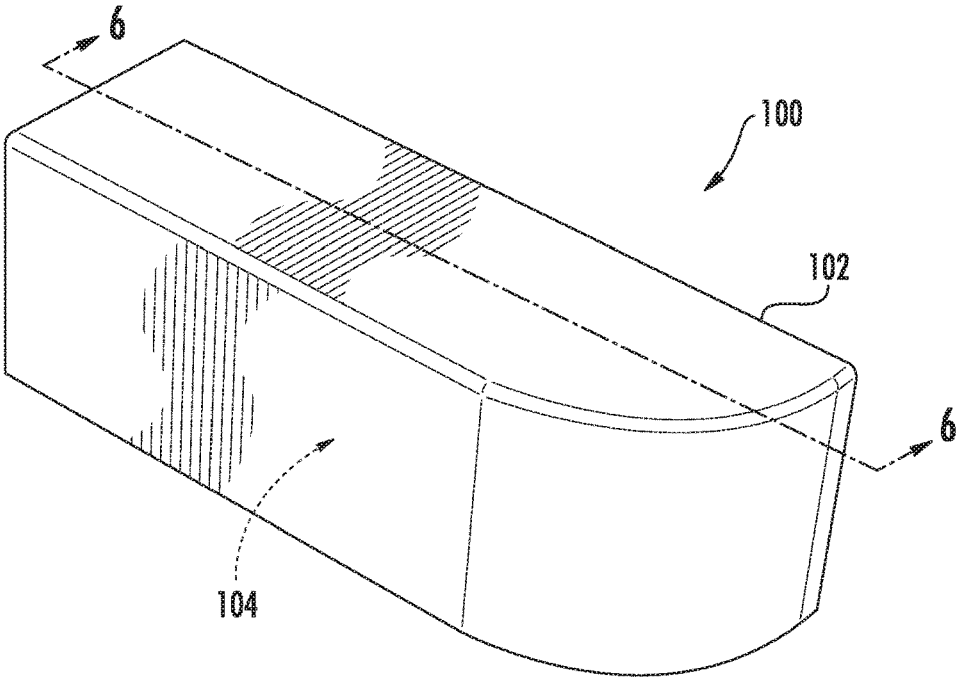
FIG. 4 is a perspective view of a housing of a corrosion inhibitor module according to an exemplary embodiment of the present subject matter.
Figure 5:
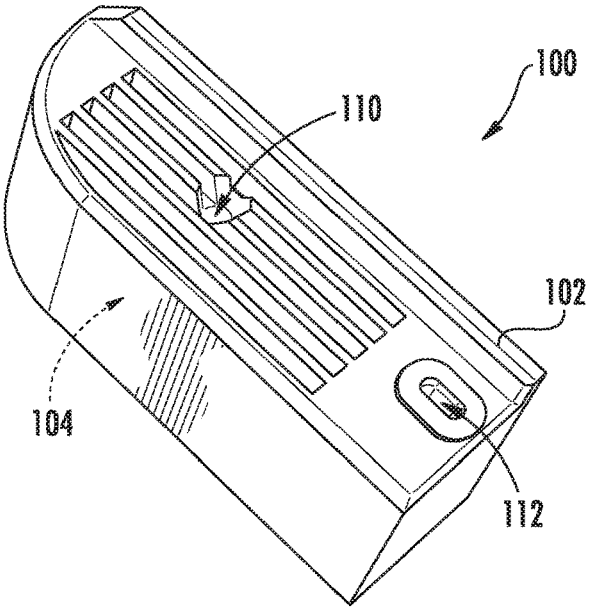
FIG. 5 is a bottom, perspective view of the exemplary housing of FIG. 4.
Figure 6:
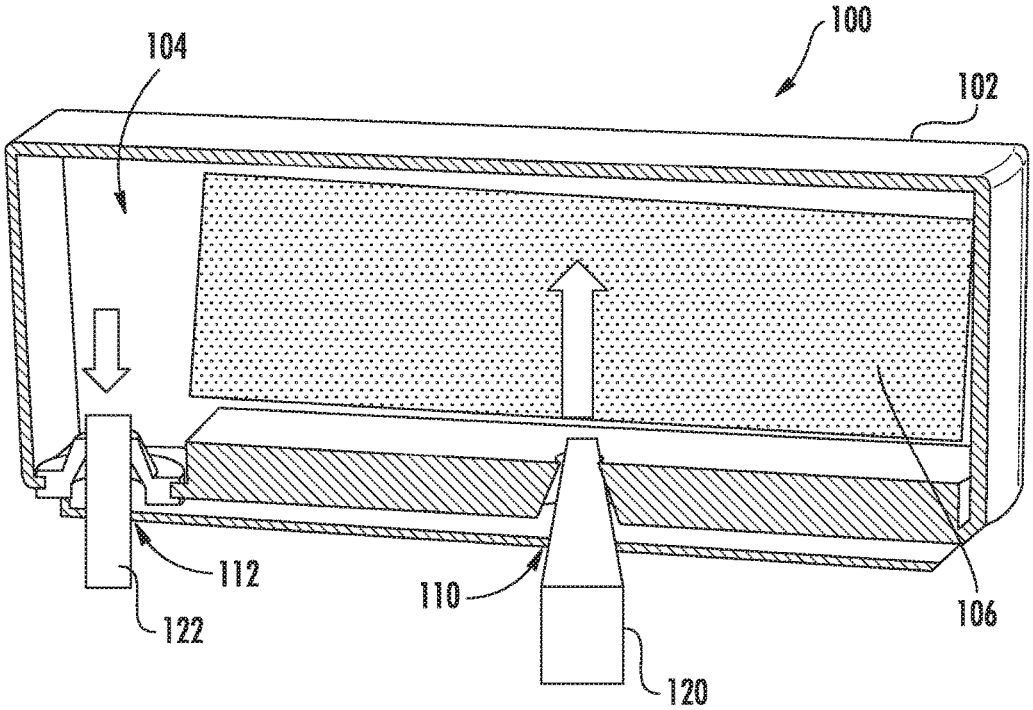
FIG. 6 is a cross-sectional view of the exemplary housing of FIG. 4, taken along Line 6-6 of FIG. 4.

Referring now to FIGS. 4 through 6, housing 102 of corrosion inhibitor module 100 will be described in more detail. More particularly, FIGS. 4 and 5 provide perspective views of housing 102 of corrosion inhibitor module 100 according to an exemplary embodiment of the present subject matter. In addition, FIG. 6 provides a cross-sectional view of housing 102, taken along Line 6-6 of FIG. 4. It should be appreciated that housing 102 is described herein only for the purpose of explaining aspects of the present subject matter and is not intended to limit the scope of the invention.

According to the illustrated embodiment, housing 102 defines a chamber 104 containing a corrosion inhibitor concentrate 106. Housing 102 may further define an inlet 110 and an outlet 112 through which condensate may be circulated through chamber 104. More specifically, condensate enters chamber 104 through inlet 110 where it mixes with a portion of corrosion inhibitor concentrate 106 to form an inhibitor solution. The inhibitor solution passes out of chamber 104 through outlet 112 and back into reservoir 82. The inhibitor solution mixes with other condensate within reservoir 82 such that the condensate has a reduced likelihood of corroding the parts that it contacts. In this regard, for example, the corrosion inhibitors attach to the various metal surfaces and act as an electrical insulator stopping the flow of ions out of the base metal into the condensate stream. According to the illustrated embodiment, inlet 110 and outlet 112 are positioned on a bottom of housing 102, although other positions are possible and within the scope of the present subject matter.

Corrosion inhibitor concentrate 106 may be any material, compound, or substance suitable for reducing the oxidizing properties of condensate collected in reservoir 82. For example, according to an exemplary embodiment, corrosion inhibitor concentrate may include one or more of Cysteine, Caffeine, 2-mercaptobenzothiazole, 2-aminobenzothiazole, 8-hydroxyquinoline, Tryptophan, Citric acid, Monoethanolamine, Arginine, Caffeine/$Zn^{2+}$, and Arginine/$Zn^{2+}$. However, other substances are possible and within the scope of the present subject matter. Preferably, corrosion inhibitor concentrate 106 is non-toxic and biodegradable.

According to the illustrated embodiment, condensate is circulated through housing 102 using a circulation system. For example, referring specifically to FIG. 7, corrosion inhibitor module 100 includes an intake conduit 120 that provides fluid communication between reservoir 82 and inlet 110 of housing 102. According to the illustrated embodiment, intake conduit 120 is a flexible, plastic tube that extends from outdoor portion 86 of reservoir 82 and draws condensate into indoor portion 84 to housing 102. However, according to alternative embodiments, intake conduit 120 may be constructed from any suitable material and may transport condensate to and from any suitable locations within unit 10. For example, intake conduit 120 could alternatively be a rigid metal tube drawing condensate from indoor portion 84. Other configurations are possible and within the scope of the present subject matter.

Figure 7:
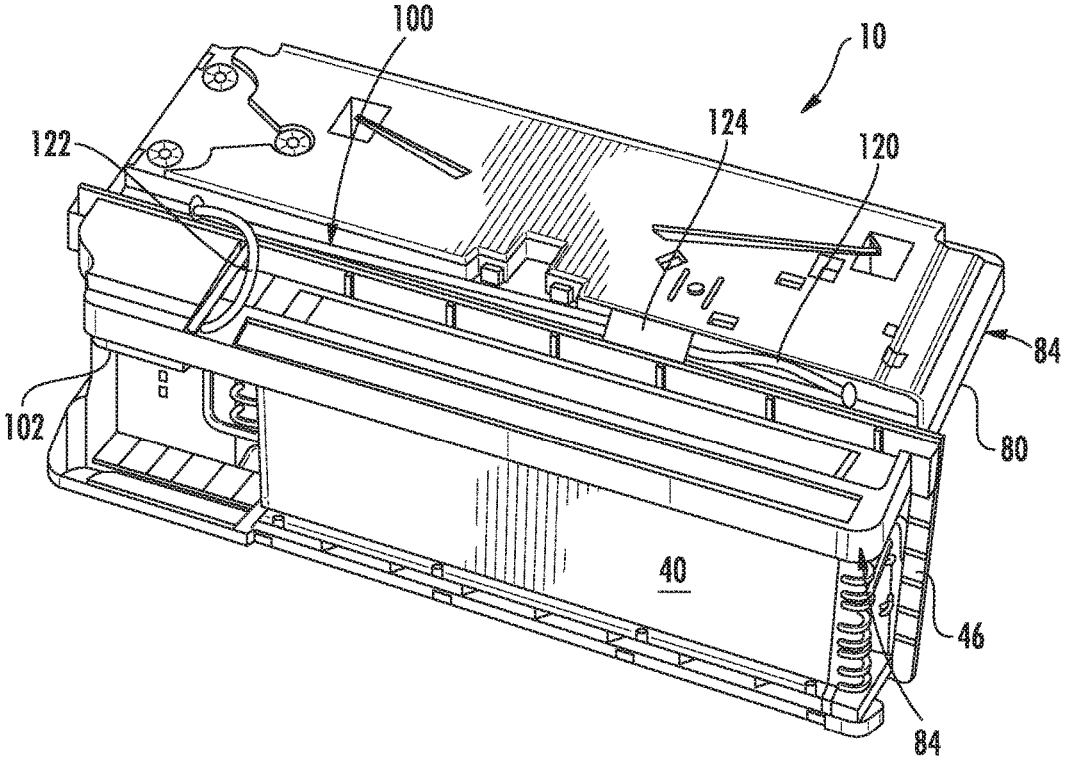
FIG. 7 is a bottom, perspective view of the exemplary air conditioner unit of FIG. 1, illustrating components of the exemplary corrosion inhibitor module in accordance with one embodiment of the present disclosure.

Still referring to FIG. 7, corrosion inhibitor module 100 includes a discharge conduit 122 that provides fluid communication between outlet 112 of housing and reservoir 82. According to the illustrated embodiment, discharge conduit 122 is a flexible, plastic tube that extends from reservoir 82 to outdoor portion 86 of reservoir 82. However, according to alternative embodiments, discharge conduit 122 may be constructed from any suitable material and may transport condensate to and from any suitable locations within unit 10. For example, discharge conduit 122 could alternatively be a rigid metal tube discharging condensate into indoor portion 84. Other configurations are possible and within the scope of the present subject matter. For example, alternative embodiments may not include a discharge conduit 122 and may instead allow inhibitor solution to drip from outlet 112 directly into reservoir 82.

According to the illustrated embodiment, corrosion inhibitor module 100 further includes a circulation pump 124 for urging a flow of condensate through chamber 104. More specifically, circulation pump 124 is operatively coupled to intake conduit 120 and may be selectively operated by controller 64. In this regard, for example, when it is desirable to introduce inhibitor solution into reservoir 82, controller 64 may operate circulation pump 124 to draw condensate into housing 102 from reservoir 82 and discharge inhibitor solution back into reservoir 82.

According to the illustrated exemplary embodiment, circulation pump 124 is a peristaltic pump. However, it should be appreciated that circulation pump 124 may be any suitable type of fluid pump having any size, configuration, or position suitable for drawing condensate out of reservoir 82 and circulating it through housing 102. For example, circulation pump 124 may be a centrifugal pump, a plunger or piston pump, a bellows or diaphragm pump, etc.

Although corrosion inhibitor module 100 is described above as including circulation pump 124 for drawing condensate into chamber 104 through intake conduit 120 and discharging corrosion inhibitor solution through discharge conduit 122, it should be appreciated that this is only one exemplary embodiment and is not intended to be limiting. In this regard, according to an alternative embodiment, intake conduit 120 may be eliminated and corrosion inhibitor solution may be supplied into reservoir 82 from another suitable source. For example, instead of using corrosion inhibitor concentrate 106, a premixed solution of water and additives (such as corrosion inhibitors) can be placed in fluid communication with reservoir 82. A valve, pump, or other dispensing means can be used to selectively discharge the premixed solution into reservoir 82 as needed to prevent corrosion. Other configurations are also possible and within the scope of the subject matter.

As explained above, corrosion inhibitor concentrate 106 is generally a substance that dissolves in condensate to form an inhibitor solution. Notably, as the amount of corrosion inhibitor concentrate 106 decreases, it may be desirable to replace corrosion inhibitor module 100 or refresh the corrosion inhibitor concentrate 106 stored in housing 102. Thus, according to an exemplary embodiment of the present subject matter, unit 10 or corrosion inhibitor module 100 may further include a replacement indicator 130. More specifically, referring for example to FIG. 2, replacement indicator 130 may be an LED indicator on control panel 66. Thus, when replacement indicator 130 lights up, this indicates that corrosion inhibitor module 100 or corrosion inhibitor concentrate 106 needs to be replaced.

According to exemplary embodiments, replacement indicator 130 provides an indication based on one or more of a time of use of corrosion inhibitor module 100, a time of use of an air conditioning mode of unit 10, an average room temperature or relative humidity during the time of use of unit 10, or a quantity of corrosion inhibitor concentrate 106. In this regard, controller 64 may be configured for monitoring these parameters and determining when replacement should occur. Although replacement indicator 130 is described as being an LED indicator positioned on control panel 66, it should be appreciated that other locations and types of indicators may be used according to alternative embodiments. For example, a passive replacement indicator 130 such as an indicator strip or viewing window could alternatively be disposed on housing 102 of corrosion inhibitor module 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:
- an outdoor heat exchanger disposed in an outdoor portion;
- an indoor heat exchanger disposed in an indoor portion;
- a bulkhead disposed between the outdoor heat exchanger and the indoor heat exchanger along a transverse direction, the bulkhead defining the indoor portion and the outdoor portion;
- a drain pan defining a reservoir for collecting condensate from the indoor heat exchanger and the outdoor heat exchanger;
- a corrosion inhibitor module comprising a module housing positioned within the reservoir and defining an inlet and an outlet, and a corrosion inhibitor concentrate positioned within the module housing;
- an intake conduit providing fluid communication between the reservoir and the inlet of the module housing; and
- a circulation pump operatively coupled to the intake conduit for urging a flow of condensate from the reservoir and into the module housing, the flow of condensate mixing with the corrosion inhibitor concentrate to form an inhibitor solution that flows back into the reservoir through the outlet.

2. The packaged terminal air conditioner unit of claim 1, comprising:
- a discharge conduit providing fluid communication between the outlet of the module housing and the reservoir.

3. The packaged terminal air conditioner unit of claim 2, wherein the discharge conduit discharges the inhibitor solution directly into the outdoor portion of the reservoir.

4. The packaged terminal air conditioner unit of claim 1, wherein the inlet and the outlet are positioned on a bottom of the module housing.

5. The packaged terminal air conditioner unit of claim 1, wherein the circulation pump is a peristaltic pump.

6. The packaged terminal air conditioner unit of claim 1, wherein the module housing of the corrosion inhibitor module is positioned within the indoor portion.

7. The packaged terminal air conditioner unit of claim 1, comprising:

a replacement indicator for providing an indication that the corrosion inhibitor module or the corrosion inhibitor concentrate needs to be replaced.

8. The packaged terminal air conditioner unit of claim 7, wherein the replacement indicator is disposed on the module housing of the corrosion inhibitor module.

9. The packaged terminal air conditioner unit of claim 7, wherein the replacement indicator provides an indication based on one or more of a time of use of the corrosion inhibitor module, a time of use of an air conditioning mode, an average room temperature or relative humidity during the time of use, or a quantity of corrosion inhibitor concentrate.

10. The packaged terminal air conditioner unit of claim 1, wherein the corrosion inhibitor concentrate is non-toxic and biodegradable.

11. The packaged terminal air conditioner unit of claim 1, wherein the corrosion inhibitor concentrate comprises one or more of Cysteine, Caffeine, 2-mercaptobenzothiazole, 2-aminobenzothiazole, 8-hydroxyquinoline, Tryptophan, Citric acid, Monoethanolamine, Arginine, Caffeine/Zn2+, and Arginine/Zn2+.

12. A corrosion inhibitor module for a packaged terminal air conditioner unit, the packaged terminal air conditioner unit comprising a drain pan defining a reservoir for collecting condensate from an indoor heat exchanger and an outdoor heat exchanger, the corrosion inhibitor module comprising:

a module housing positioned within the reservoir and defining a chamber having an inlet and an outlet;

a corrosion inhibitor concentrate positioned within the module housing;

an intake conduit providing fluid communication between the reservoir and the inlet of the module housing; and a circulation pump operatively coupled to the intake conduit for urging a flow of condensate from the reservoir and into the chamber, the flow of condensate mixing with the corrosion inhibitor concentrate to form an inhibitor solution that flows back into the reservoir through the outlet.

13. The corrosion inhibitor module of claim 12, comprising:

a discharge conduit providing fluid communication between the outlet of the module housing and the reservoir.

14. The corrosion inhibitor module of claim 13, wherein the discharge conduit discharges the inhibitor solution directly into an outdoor portion of the reservoir.

15. The corrosion inhibitor module of claim 12, wherein the inlet and the outlet are positioned on a bottom of the module housing.

16. The corrosion inhibitor module of claim 12, wherein the circulation pump is a peristaltic pump.

17. The corrosion inhibitor module of claim 12, wherein the module housing of the corrosion inhibitor module is positioned within an indoor portion.

18. The corrosion inhibitor module of claim 12, comprising:

a replacement indicator for providing an indication that the corrosion inhibitor module or the corrosion inhibitor concentrate needs to be replaced, wherein the replacement indicator provides an indication based on one or more of a time of use of the corrosion inhibitor module, a time of use of an air conditioning mode, an average room temperature or relative humidity during the time of use, or a quantity of corrosion inhibitor concentrate.

19. The corrosion inhibitor module of claim 12, wherein the corrosion inhibitor concentrate comprises one or more of Cysteine, Caffeine, 2-mercaptobenzothiazole, 2-aminobenzothiazole, 8-hydroxyquinoline, Tryptophan, Citric acid, Monoethanolamine, Arginine, Caffeine/Zn2+, and Arginine/Zn2+.

20. A packaged terminal air conditioner unit, comprising:

an outdoor heat exchanger disposed in an outdoor portion;

an indoor heat exchanger disposed in an indoor portion;

a bulkhead disposed between the outdoor heat exchanger and the indoor heat exchanger along a transverse direction, the bulkhead defining the indoor portion and the outdoor portion;

a drain pan defining a reservoir for collecting condensate from the indoor heat exchanger and the outdoor heat exchanger;

a corrosion inhibitor module comprising a module housing positioned within the reservoir and defining an inlet and an outlet, and corrosion inhibitor solution positioned within the module housing including a discharge conduit fluidly coupled to the outlet of the module housing and being in fluid communication with the reservoir; and a circulation pump operatively coupled to the discharge conduit for urging a flow of the corrosion inhibitor solution from the module housing, through the discharge conduit, and into the reservoir.

* * * * *